US005557953A

United States Patent [19]

Massotte et al.

[11] Patent Number: 5,557,953

[45] Date of Patent: Sep. 24, 1996

[54] MACHINE FOR DYEING TEXTILE YARNS

[75] Inventors: Philippe Massotte, Wintzenheim; Hubert Liebmann, Wittelsheim, both of France

[73] Assignee: Superba, Mulhouse, France

[21] Appl. No.: 426,952

[22] Filed: Apr. 24, 1995

[30] Foreign Application Priority Data

Apr. 22, 1994 [FR] France ..... 94 04877

[51] Int. Cl.[6] ..... D06B 1/02

[52] U.S. Cl. ..... 68/205 R

[58] Field of Search ..... 68/205 R; 118/301, 118/325, 326, DIG. 21

[56] References Cited

U.S. PATENT DOCUMENTS 4,380,158 4/1983 Bous ..... 68/205 R
4,662,194 5/1987 Stanley ..... 68/205 R
4,803,746 2/1989 Bryant ..... 68/205 R X
5,016,308 5/1991 McBride et al. ..... 68/205 R X

FOREIGN PATENT DOCUMENTS 2650311 2/1991 France .
0026843 4/1981 WIPO .

*Primary Examiner*—Philip R. Coe
*Attorney, Agent, or Firm*—Young & Thompson

[57] ABSTRACT

A machine for continuously dyeing textile yarns (20) comprises at least one dye application station (15A). The latter comprises dye-sprayer (14) and protective sheat (21) through which the yarns (20) extend, and which has an open portion (21*a*) situated in line with the dye-sprayer (14) and in which the yarns (20) are opposite dye-sprayer (14). A shutter (16) is arranged between the textile yarns (20) and the dye-sprayer (14) in order alternately to intercept or let through the jet (17) of dye sprayed towards the yarns (20).

6 Claims, 3 Drawing Sheets

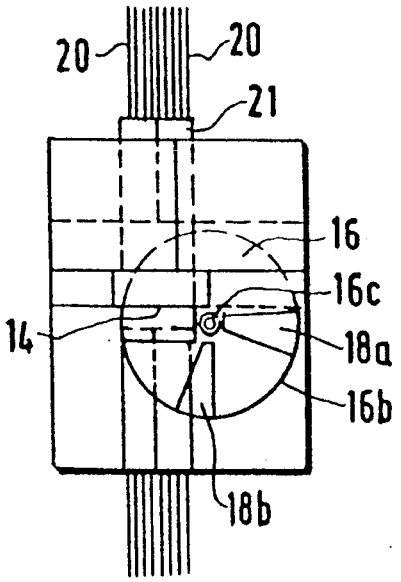
FIG. 4
FIG. 5A
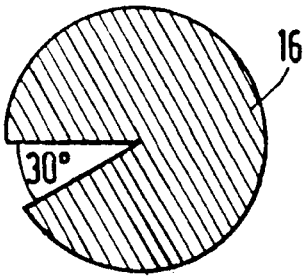
FIG. 5B
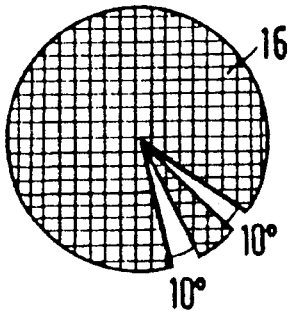
FIG. 5C
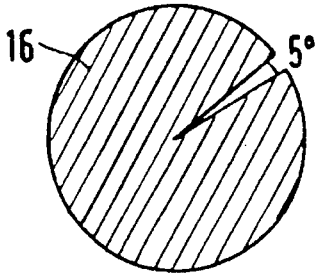
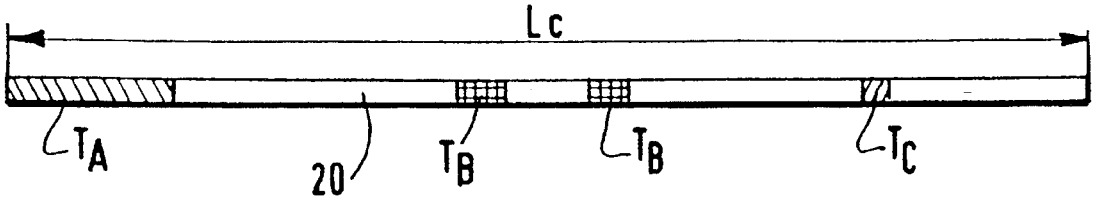
FIG. 5D

MACHINE FOR DYEING TEXTILE YARNS

The present invention relates to a machine for dyeing textile yarns comprising at least one dye application station in front of which a plurality of textile yarns continuously moves, said dye application station comprising dye-spraying means configured to send out a jet of dye which is tranverse with respect to the direction of movement of the yarns, in a region in which said yarns pass.

Machines for continuously dyeing textile yarns make it possible to apply dyes of different colors to continuously moving textile yarns.

The textile yarns are used particularly for producing rugs or carpets.

Such a machine is described in French Patent 89 10 277 of Jul. 26, 1989 in the name of the Applicant.

This machine includes a casing within which are mounted an application station for applying a plain dye by means of a fixed spraying nozzle and three application stations comprising dyeing turbines intended for applying discontinuous spots of dye onto the yarns.

Each turbine includes several holes for the dye to pass through at its periphery, so as to produce several spots of color on the textile yarns.

The succession of dye application stations makes it possible, over a certain length of yarn, to create a pattern which is repeated continually and which consists of a series of different spots of color in a given order of colors.

Different patterns can be created by varying the position of the holes over the periphery of each turbine, the diameter of these holes, the speed of rotation of the turbines and the speed of movement of the yarn.

Satisfactory results are obtained with this machine when the patterns consist of relatively short spots of color, of the order of 5 cm long.

On the other hand, patterns consisting of longer spots, from 20 to 30 cm for example, cannot be created in practice: in fact, to do that, it would be appropriate to give the turbines holes of large diameter and to drive each turbine at a slow rotational speed. These conditions would have the consequence of excessively wetting the textile yarns, which makes the subsequent stage of fixing the colorants by vaporizing much more difficult.

Moreover, at the exit from the various dye application stations, the textile yarns are generally wound on themselves so as to be deposited on a conveyor belt. When the textile yarns are too loaded with colorants, splashing of colorants is observed during the deposition stage and mixing of the various colors is frequently observed.

The document EP 0 26 843 describes a dye application station which is traversed by a yarn which receives the spray of a jet of dye from a spraying nozzle sending out a jet which is tranverse with respect to the direction of movement of this yarn. Between the spraying nozzle and the yarn is placed a disc pierced with pointlike holes and with slots, configured into a circle concentric to the disc. The yarn receives a jet of dye when a hole or a slot is in line with the spraying nozzle, but receives no jet of dye when a solid part of the disc is between the nozzle and the yarn. The disc device as described in EP 0 26 843 allows only one single yarn to be dyed at a time. In this device, the yarn traverses the dyeing chamber without being protected over the whole of the journey within the chamber. As this chamber is permanently filled with a mist of dye, the yarn undergoes not only dyeing in the form of spots when an aperture of the rotating disc comes in line with the dyeing jet, but also a continuous dyeing from the atmosphere of the chamber during the entire journey through it. The yarn thus receives not only isolated spots but also a continuous background. If several dyeing chambers of this type are arranged in series, the yarn receives a continuous background, a mixture of the different successive dyeings, and the color shading of the spots produced by each chamber is influenced by this dye background.

The object of the present invention is to remedy the abovementioned drawbacks and to provide a machine which makes it possible to create any type of patterns on the textile yarns.

This object is achieved by virtue of a machine of the type defined above, in which said dye application station comprises means forming a protective sheath in which the textile yarns extend, said protective sheath-forming means having an open portion situated in line with the dye-spraying means and in which the textile yarns are opposite dye-spraying means, and said dye application station is equipped with shutter-forming means arranged between the textile yarns and the dye-spraying means and configured alternately to intercept or to let through the jet of dye sprayed towards the textile yarns, said shutter-forming means comprising a rotating disc including at least one aperture extending substantially in the direction of a radius of the disc, the dye-spraying means extending substantially in the direction of a radius of the disc.

Thus, by virtue of the shutter-forming means, it is possible to vary the pattern created on the textile yarns, that is to say particularly the length of the dye spots applied, independently of the dye spraying means.

On the other hand, it is equally possible to alter the flow rate of the jet of colorant sprayed without that having any influence on the pattern obtained.

It is also possible by virtue of the invention to create large spots of color on textile yarns while keeping the flow rate of the jet of colorant sprayed by the dye-spraying means at a low level.

The textile yarns after dyeing are consequently not excessively wetted, which avoids the problems of splashing and of mixing of the colorants during the subsequent state of depositing the textile yarns, and facilitates the fixing of the colorants during vaporization.

According to a preferred version of the invention, said rotary disc rotates about a shaft substantially parallel to the direction of the sprayed dye jet.

Thus, by virtue of the rotary movement of the disc provided with an aperture, a spot of color is periodically created on the textile yarns, in a much more regular way than with shutter-forming means given a to-and-fro movement.

Depending on the position of the apertures on the disc, on their dimensions and on the speed of rotation of the disc, it is possible to modify the spacing between each spot of color and the length of each of them, so that it is possible to create all types of patterns on the textile yarns.

According to an advantageous version of the invention, the aperture of the disc consists of an angular sector of the disc.

When a layer of yarns is moving under the disc, all the yarns are dyed identically whatever their position with respect to the center of rotation of the disc.

With the relative speed of the disc with respect to the layer of yarns being lower at a point close to the center of rotation of the disc than at a peripheral point, the shape of the aperture makes it possible to expose the same length of yarn to the jet of dye over all of the yarns of the layer.

Other features and advantages of the invention will be more apparent in the following description.

In the attached drawings, given by way of non-limiting example:

FIG. 4 is a top view of FIG. 2; and

FIG. 5 is an example of a textile yarn dyed by a machine in accordance with the invention.

Figure 1:
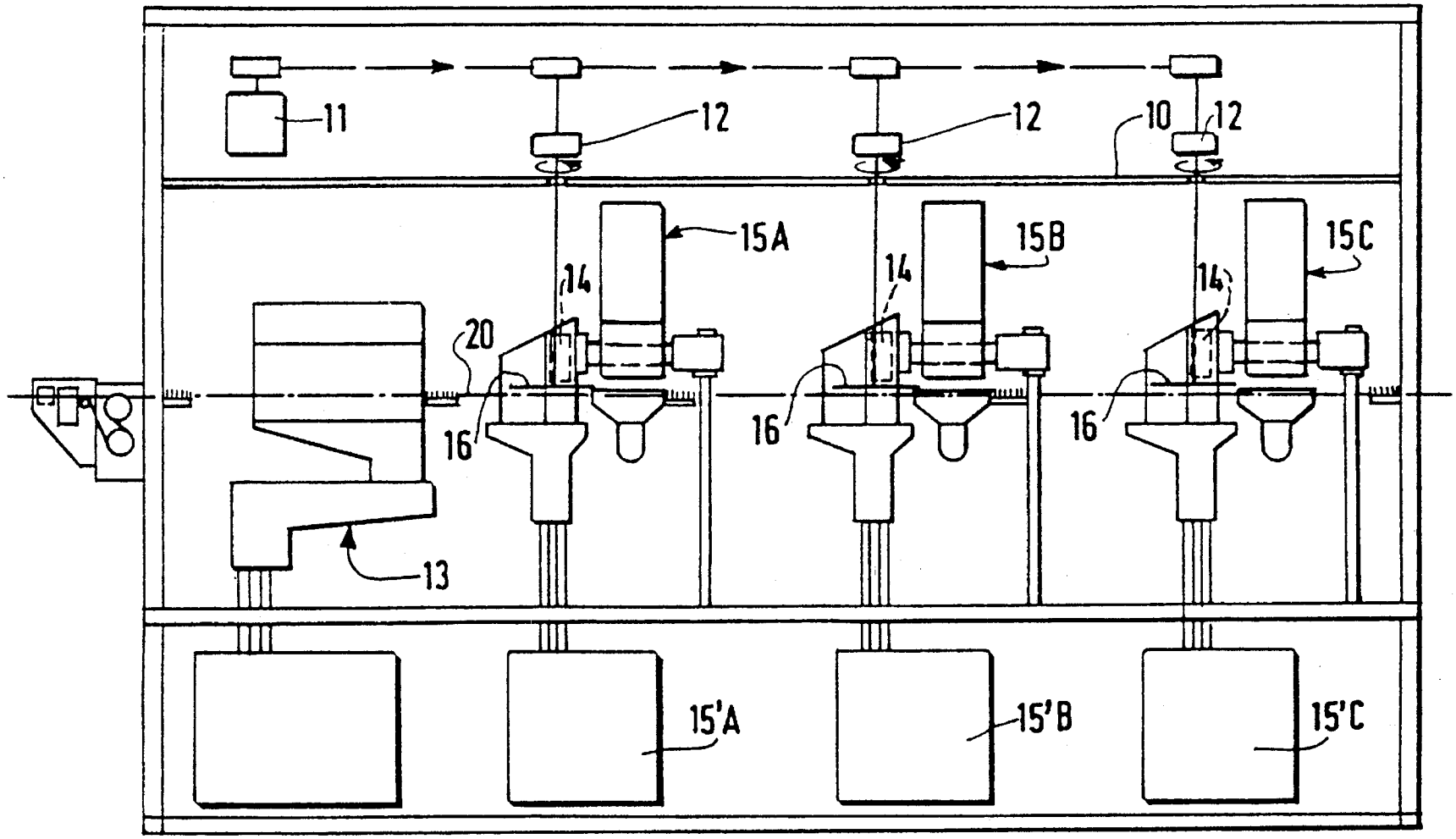
FIG. 1 is an overall view in elevation of a machine according to the invention.

With reference first of all to FIG. 1, the machine in accordance with the invention makes it possible continuously to dye textile yarns 20 which are moving in front of dye application stations 15A, 15B, 15C.

For fuller details, reference may be made to the French Patent 89 10 277.

The textile yarns 20 are arranged in layers, parallel to one another in a substantially horizonatal plane.

A first dye bath 13 preferably makes it possible to give all the yarns 20 a uniform base color.

Each dye application station 15A, 15B, 15C allows preferably different spots of color to be applied to the textile yarns 20.

Dye-spraying means 14 are configured to spray dye onto the yarns 20.

These spraying means 14 consist, in this embodiment, of a fixed flat nozzle 14.

Regulation means make it possible to regulate the flow rate of the sprayed dye jet, depending particularly on the speed of movement of the yarns 20 and on the quality of the yarns 20.

Corresponding to each dye application station 15A, 15B, 15C there is a device 15'A, 15'B, 15'C for recovering and recycling the sprayed dye which has not been absorbed by the textile yarns 20.

Figure 2:
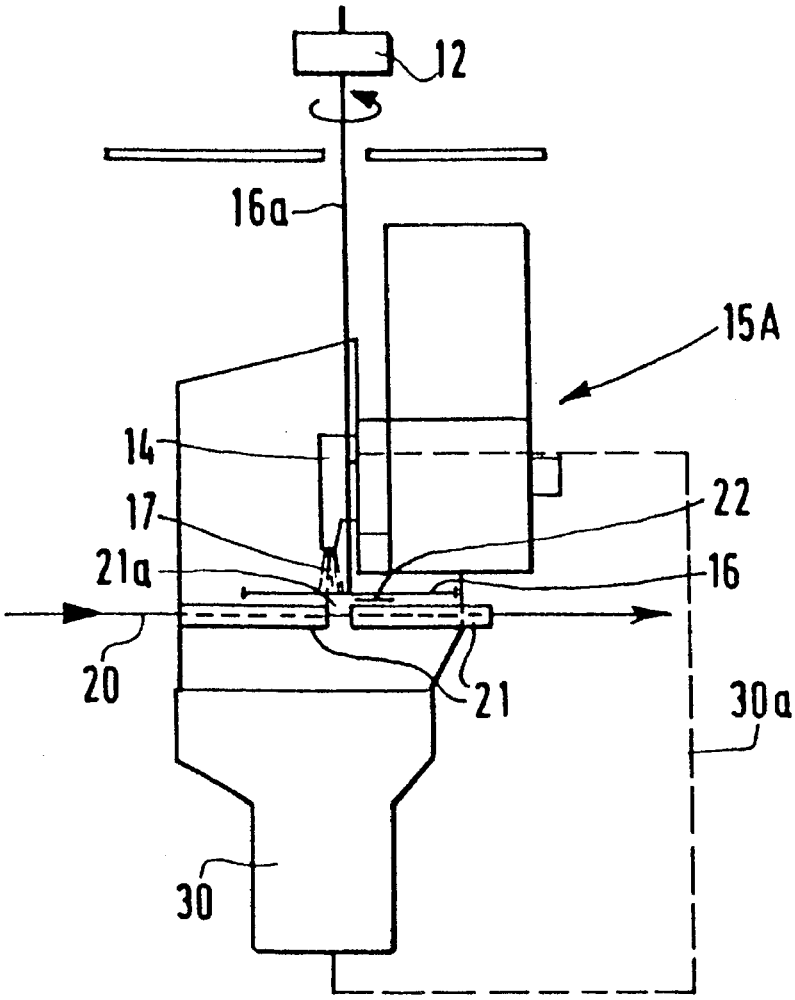
FIG. 2 is a diagrammatic view of a dye application station of a machine in accordance with the invention.
Figure 3:
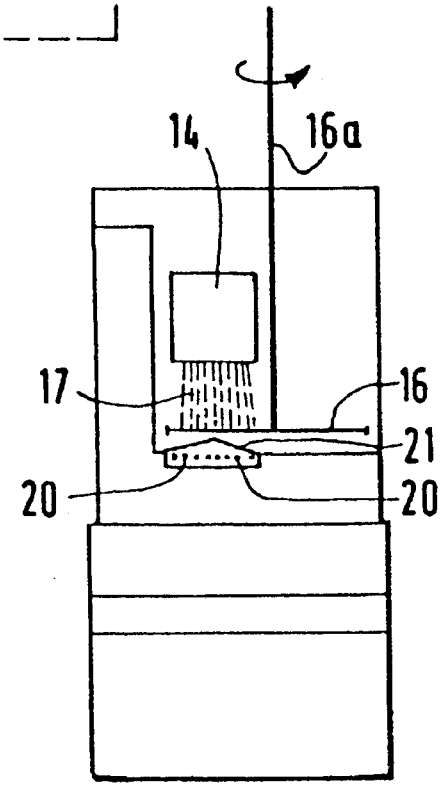
FIG. 3 is a side view of FIG. 2.

As illustrated better in FIGS. 2 and 3, protective sheath-forming means 21 are configured to protect the textile yarns 20 which are moving past. They have an open portion 21*a* situated in line with the nozzle 14, so that the yarns 20 are opposite the nozzle 14, under the dye jet 17.

This protective sheath makes it possible to carry out dyeing of the yarns 20 only over the restricted portion 21*a* of the path of the textile yarns 20.

In accordance with the invention, each application station 15A, 15B, 15C comprises a shutter-forming disc 16 driven in rotation about a shaft 16*a* substantially parallel to the direction of the sprayed dye jet 17.

This disc 16, in the example illustrated in FIG. 3, includes two apertures 18*a*, 18*b* extending in the direction of a radius of the disc 16.

The nozzle 14 is also arranged in the direction of a radius of the disc 16.

Each aperture 18*a*, 18*b* consists of an angular sector of the disc 16, so as to create spots of equal length on the yarns 20 of the layer, whether the yarn 20 is situated close to the center of the disc 16 or at its periphery.

The machine in accordance with the invention, as illustrated in FIG. 1, comprises means 11, 12 for synchronizing the rotation of the discs 16 of each application station 15A, 15B, 15C.

These synchronization means may consist, in a known way, of a stepped-down motor 11 which, via a non-slipping transmission, actuates angular synchronization devices 12 on which the rotational shafts 16*a* of the discs 16 are mounted respectively.

The synchronization means 11, 12 are preferably housed above a ceiling 10 so as to be sheltered from the contamination of the textile yarn dyeing shops.

Moreover, each application station for the dye 15A, 15B, 15C comprises a screen 22 configured to be moved between an open position and a closed position in which it shuts off the open portion 21*a* of the protective sheath-forming means 21.

Thus, these screens 22 come to be placed between the jet 17 of colorant and the layer of yarns 20 so as to protect the latter.

These screens 22 are driven either simultaneously for all the application points 15A, 15B, 15C in the event of complete stoppage of the machine or of the movement of the textile yarns 20, or individually when it is desired, for example, momentarily to stop the dyeing of one color on the yarns 20.

The shutter-forming means 16 preferably consist of a thin sheet of plastic, which can easily be cut up to create the apertures 18*a*, 18*b* for the dye to pass through.

The disc 16 has to be both light and rigid. For preference, a peripheral ring 16*b* makes it possible to reinforce the structure of the disc 16, which is weakened by the apertures 18*a*, 18*b*.

The latter are not extended as far as the center of the disc 16, in order to allow a ring 16*c* to be mounted around the rotational shaft 16*a* and thus to avoid the disc wobbling around its shaft 16*a* in the horizontal plane.

The shaft 16*a* of the disc 16 is offset with respect to the axis of the nozzle 14, so that the jet 17 of colorant is distributed over the whole extent of the apertures 18*a*, 18*b* of the disc 16.

The invention will be better understood on reading the embodiment example described below with reference to FIG. 5.

In this example, the machine in accordance with the invention includes three dye application stations each configured to apply a different color A, B or C.

Each dye application station is equipped with a disc 16 including either an angular aperture of 30° (color A), or two angular apertures of 10° (color B), or an angular aperture of 5° (color C).

The rotation of these discs 16 is synchronized so that the spots of color TA, TB, TC deposited on the yarn 20 are separate.

The length of a cycle LC on the yarn, that is to say the length of the pattern which is continuously repeated along the yarn 20, is a function of the speed of rotation Vo of the discs 16 and of the speed Vf of movement of the yarn 20, according to the relation:

$$LC = \frac{Vf}{Vo}$$

Thus, if the yarn has a speed Vf equal to 300 m/min and each disc a speed of rotation Vf equal to 100 rpm, the length of a cycle LC on the yarn 20 will be equal to 3 meters.

The speed of the yarns 20 is generally dictated by the production capacity of the continuous dyeing machine and by the size of the yarns 20.

For given yarns, the length LC of the pattern is therefore altered by varying the speed of rotation Vo of the discs 16.

The length $L_T$ of the spots TA, TB, TC depends on the angle α of the apertures of the disc 16 and on the relative speed of the discs 16 with respect to the yarn 20 according to the following relation:

$$L_T = \frac{\alpha}{360} \times \frac{Vf}{Vo} = \frac{\alpha}{360} \times LC$$

Thus, in the example illustrated in FIG. 5, the length of the spots TA of color A is equal to 0.25 m, the length of the spots TB of color B is equal to 0.08 m and the length of the spots TC of color C is equal to 0.04 m.

Once the length LC of the cycle is determined, it is possible to alter the length of the spots TA, TB, TC by varying the angle α of the apertures created in the discs 16.

Thus it is possible, by virtue of the shutter-forming means 26, easily to modify the patterns dyed on the textile yarns, and particularly create long spots of color, without influencing the flow rate of dye sprayed.

Clearly, the invention is not limited to the embodiment described above, and numerous modifications can be applied to it without departing from the scope of the invention.

Thus, the dye-spraying means 14 can be turbines rotating about an axis parallel to the axis of movement of the yarns 20.

Each turbine includes holes all around its periphery. The dimension and the distribution of these holes make it possible to regulate the flow rate of dye sprayed, and take no further part, in contrast to the machines of the prior art, in the patterns produced on the yarns 20.

By way of indication, the holes at the periphery of the turbine may have a diameter of 0.5 mm, and the turbine is driven in rotation at a speed equal to about 1500 rpm.

The disc 16, instead of being capable of being cut out to create apertures, may be designed in such a way as to possess apertures of adjustable dimension, for example by virtue of two or more discs turning upon one another about a common rotational shaft 16*a* and each possessing apertures which can be made more or less to coincide in order to define larger or smaller apertures for the dye to pass through.

We claim:

1. A machine for dyeing textile yarns (20) comprising at least one dye application station (15A, 15B, 15C) in front of which a plurality of textile yarns (20) moves continuously, said dye application station (15A, 15B, 15C) comprising dye-spraying means (14) configured to send out a jet of dye (17) which is tranverse with respect to the direction of movement of said yarns (20) in a region in which said yarns pass, wherein said dye application station (15A, 15B, 15C) comprises means forming a protective sheath (21) in which the textile yarns (20) extend, said protective sheath-forming means (21) having an open portion (21*a*) situated in line with the dye-spraying means (14) and in which the textile yarns (20) are opposite dye-spraying means (14), and wherein said dye application station (15A, 15B, 15C) is equipped with shutter-forming means (16) arranged between the textile yarns (20) and the dye-spraying means (14) and configured alternately to intercept or to let through the jet (17) of dye sprayed towards the textile yarns (20), said shutter-forming means comprising a rotating disc (16) including at least one aperture (18*a*, 18*b*) extending substantially in the direction of a radius of the disc (16), the dye-spraying means (14) extending substantially in the direction of a radius of the disc (16).

2. The machine as claimed in claim 1, wherein said rotary disc (16) rotates about a shaft (16*a*) substantially parallel to the direction of the sprayed dye jet (17).

3. The machine as claimed in claim 2, which comprises means (11, 12) for synchronizing the rotation of the discs (16) of each dye application station (15A, 15B, 15C).

4. The machine as claimed in claim 1, wherein said aperture (18*a*, 18*b*) consists of an angular sector of the disc (16).

5. The machine as claimed in claim 1, wherein the dye-spraying means (14) consist of a fixed flat nozzle.

6. The machine as claimed in claim 1, wherein each application station for the dye (15A, 15B, 15C) further comprises a screen (22) configured to be moved between an open position and a closed position in which it shuts off the said open portion (21*a*) of the protective sheath-forming means (21).

* * * * *